US007065879B2

(12) United States Patent
Bader et al.

(10) Patent No.: US 7,065,879 B2
(45) Date of Patent: Jun. 27, 2006

(54) SHAVING FOIL PATTERNING

(75) Inventors: Raoul Bader, Mainz (DE); Matthias Gradl, Sesslach (DE); Sebastian Hottenrott, Idstein (DE); Peter Junk, Seelenberg (DE); Christof Kleemann, Eschborn (DE); Michael Meiss, Friedberg (DE); Uwe Neumann, Wiesbaden (DE); Michael Odemer, Niddatal-Assenheim (DE); Andreas Reklau, Coburg (DE); Jens Storkel, Frankfurt (DE); Petri Toivanen, Copenhagen (DK); Till Winkler, Kronberg (DE); Jurgen Wolf, Kriftel (DE)

(73) Assignee: Braun GmbH, Kronberg (DE)

( * ) Notice: Subject to any disclaimer, the term of this patent is extended or adjusted under 35 U.S.C. 154(b) by 0 days.

(21) Appl. No.: 10/772,189

(22) Filed: Feb. 4, 2004

(65) Prior Publication Data

US 2004/0168321 A1 Sep. 2, 2004

Related U.S. Application Data

(63) Continuation of application No. PCT/EP02/08272, filed on Jul. 25, 2002.

(30) Foreign Application Priority Data

Aug. 9, 2001 (DE) ..... 101 39 209

(51) Int. Cl.
*B26B 19/02* (2006.01)

(52) U.S. Cl. ..... 30/43.92; 30/43; 30/346.51

(58) Field of Classification Search ..... 30/346.51, 30/43.92, 43

See application file for complete search history.

(56) References Cited

U.S. PATENT DOCUMENTS

| | | | | |
|---|---|---|---|---|
| 3,382,580 A | | 5/1968 | Rinck et al. | |
| 3,696,508 A | * | 10/1972 | Messinger | 30/43 |
| 4,985,999 A | | 1/1991 | Iwasaki et al. | |
| 5,185,933 A | * | 2/1993 | Messinger | 30/346.51 |

FOREIGN PATENT DOCUMENTS

| | | |
|---|---|---|
| DE | 70 38 682 | 3/1971 |
| DE | 15 53 668 | 5/1976 |
| DE | 26 07 228 | 9/1976 |
| DE | 35 26 951 | 1/1987 |
| WO | WO 98/48983 | 11/1998 |

OTHER PUBLICATIONS

Andrew Glassner's Notebook; XP-000927332 "Penrose Tiling"; Jul./Aug. 1998; pp. 78-86.
J. Rangel-Mondragon et al; XP 002035593 "Computer Generation of Penrose Tilings"; Computer Graphics Forum 7 (1988) 29-37.
Von David R. Nelson; XP-002220466 "Quasikristalle" Oct. 1986; pp. 74-83.

* cited by examiner

*Primary Examiner*—Timothy V. Eley
*Assistant Examiner*—Isaac N. Hamilton
(74) *Attorney, Agent, or Firm*—Fish & Richardson P.C.

(57) ABSTRACT

The invention is directed to a shaving foil for a shaving system of a shaving apparatus, in which the shaving foil cooperates with an undercutter adapted to be driven relative to the shaving foil. The shaving foil includes a perforate region comprised of a plurality of hair-receiving apertures, wherein said apertures form a quasi-periodic pattern executed in accordance with a Penrose parquet.

34 Claims, 4 Drawing Sheets

SHAVING FOIL PATTERNING

RELATED APPLICATIONS

This application is a continuation of PCT application number PCT/EP02/08272, filed Jul. 25, 2002, which claims priority from German application serial no. 101 39 209.5, filed Aug. 9, 2001. The entire contents of the above PCT application are herein incorporated by reference.

TECHNICAL FIELD

This invention relates shaving foil patterning. More particularly, the invention relates to patterning a shaving foil to include at least one perforate region comprised of a plurality of hair-receiving apertures.

BACKGROUND

Known shaving foils are usually equipped with a periodically recurring aperture pattern in which the aperture cross-sections have a hexagonal, honeycomb-shaped geometry, a slot-shaped and/or circular geometry, or polygonal geometry—in particular equilateral polygonal geometry. Complete parqueting of the foil surface is easy to accomplish with honeycomb-shaped apertures. At the same time, foils having honeycombed-shaped apertures can include a very favorable ratio of bar area (e.g., solid area around the aperture) to aperture area. Foils with a honeycomb-shaped aperture structure have proven successful in practice for many years and enable a particularly thorough shave, while at the same time are extremely gentle on the skin.

When designing aperture patterns for shaving foils it is always necessary to optimize the compromise between thoroughness, for which particularly large aperture dimensions are suitable, and gentle treatment of the skin, which can be improved by smaller aperture dimensions. For example, in a more expansive shaving foil aperture, the skin can be pressed partially closer to the undercutter as the undercutter moves relative to the shaving foil. As a result, thoroughness is improved because the undercutter can be moved closer toward the hair root. However, at the same time, there is a higher risk, of course, that the user's skin will be irritated or at worst injured because the user's skin is also moved closer to the undercutter.

Regularly arranged aperture patterns result in very little variation in the alignment of the bars between the apertures. Bar alignment plays a particularly great role in the actual process of threading in and cutting hair. Generally, in foils having honeycombed-shaped apertures and/or foils described in accordance with DE-A 1 553 668, there are three to four preferred directions of parallel running bars in relation to the blades of the moving undercutter. Hair growth on the human skin, particularly growth of beard hair, is highly irregular by comparison, not only with regard to the distribution of individual hairs on the skin surface but also in terms of the spatial alignment of individual hairs in relation to each other. Hence, the more alignments provided by the bars of a shaving foil, the greater the probability of a cutting action taking place between a bar and a blade of an undercutter.

Shaving foils can also include several perforate regions, each with a different aperture geometry as shown in DE-A 1 553 668. However, the aperture patterns of the individual perforate regions shown in DE-A 1 553 668 are themselves periodic, and thus limit the probability of a cutting action taking place.

SUMMARY

It is an object of the present invention to provide a prior-art shaving foil that surpasses the known shaving foils, which are already of the highest quality standard, in terms of thoroughness and gentle treatment of the skin.

An aspect of the invention features a shaving foil designed in such a way that the perforate region forms a quasi-periodic pattern executed according to the Penrose parquet.

Penrose parquets are named after Roger Penrose who conducted theoretical investigations into irregular patterns that possess no translational symmetry or periodicity; refer also to the essay "Quasikristalle" by David Nelson, published in "Spektrum der Wissenschaft", October 1986, pages 74–93.

In one aspect, the invention features a shaving foil for a shaving apparatus with at least one shaving foil and a cooperating undercutter adapted to be driven relative to each other. The shaving foil includes at least one perforate region including a plurality of hair-receiving apertures and having a quasi-periodic pattern executed according to the Penrose parquet.

In another aspect, the invention features a shaving foil for a shaving system. The shaving foil inclueds at least one perforate region including a plurality of hair receiving apertures and having a quasi-periodic pattern arranged to have at least five-fold symmetry (e.g., five-fold symmetry, 10-fold symmetry, 12-fold symmetry).

In another aspect, the invention features a shaving apparatus including a shaver head including an undercutter, a frame attached to the shaver head, and at least one shaving foil carried by the frame, wherein the shaving foil includes at least one perforate region including a plurality of hair-receiving apertures and having a quasi-periodic pattern executed according to the Penrose parquet.

In another aspect, the invention features a method of shaving hair. The method includes applying the above-described shaving apparatus to skin including hair and activating the undercutter.

According to an advantageous aspect of the invention, a provision is made for the perforate region of the shaving foil to be formed by complete parqueting using at least two different surface section elements, said surface section elements being equipped with at least one aperture. This embodiment offers the possibility of implementing different aperture sizes and/or aperture geometries.

In some embodiments of the invention, the perforate region is formed by complete parqueting using at least two different surface section groups, each being equipped with at least one aperture, said surface section groups being each comprised of at least two surface section elements. This embodiment also offers numerous variation options for arranging apertures of different size and/or geometry. By combining several surface section elements to form surface section groups the number of possible combinations of different apertures is significantly increased.

In some embodiments, the surface section elements are shaped as rhombuses, which are suitable for complete parqueting. In this embodiment, it is particularly advantageous for the acute angle of the rhombuses to equal 36° and/or 72°, with the surface section elements having in particular the same edge length. This takes account of the fact that the more acute the angles of the rhombuses, the greater the loss of aperture area on the foil due to the necessary rounding of the corners, which will be subsequently described.

The shaving foil of the present invention is suitable for all shaving apparatus drive concepts, regardless of the relative movement between the shaving foil and the undercutter.

The details of one or more embodiments of the invention are set forth in the accompanying drawings and the description below. Other features, objects, and advantages of the invention will be apparent from the description and drawings, and from the claims.

DESCRIPTION OF DRAWINGS

Like reference symbols in the various drawings indicate like elements.

DETAILED DESCRIPTION

Figure 1:
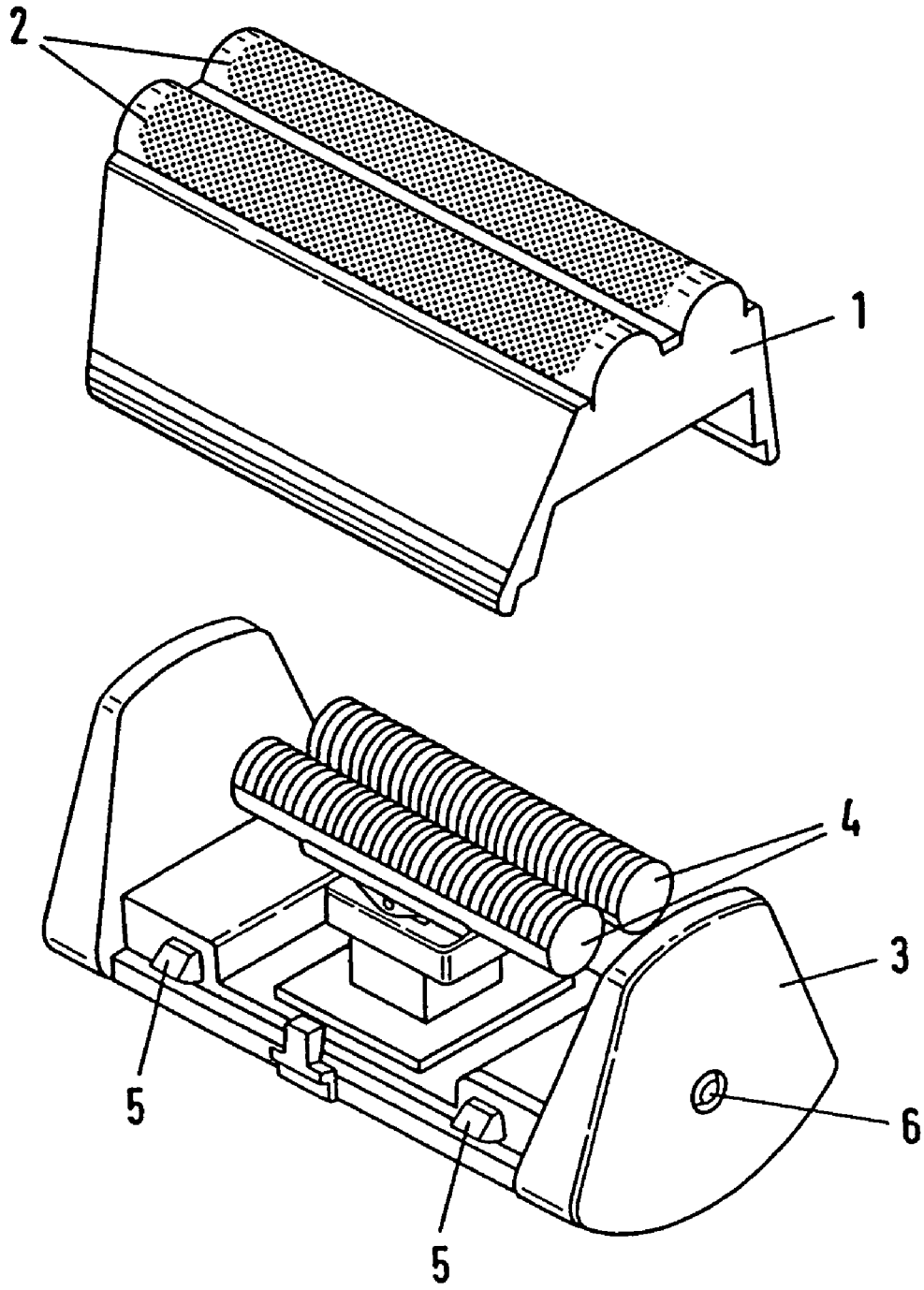
FIG. 1 shows the basic design of a shaver head.

FIG. 1 shows an exchangeable frame 1 which carries two shaving foils 2, each having a perforate region comprising a plurality of hair receiving apertures. Associated with the exchangeable frame 1 is a shaver head 3 which has undercutters 4 that are adapted to be driven in oscillatory manner. The drive mechanism itself is not shown in the drawing for better clarity and can be configured, for example, as an eccentric drive with an electric motor. The exchangeable frame 1 can be locked with the shaver head 3 by means of detent elements 5. The exchangeable frame 1 is detachable from the shaver head 3 by actuating a release button 6, for example for cleaning and maintenance purposes.

The undercutters 4 are configured in known fashion each as a blade assembly having a plurality of blades arranged parallel with one another.

Beard hairs threaded in from the outside through the apertures of the shaving foil 2 are captured during the shaving process by the oscillating undercutters 4 and are sheared off on the bars surrounding the apertures.

Figure 2:
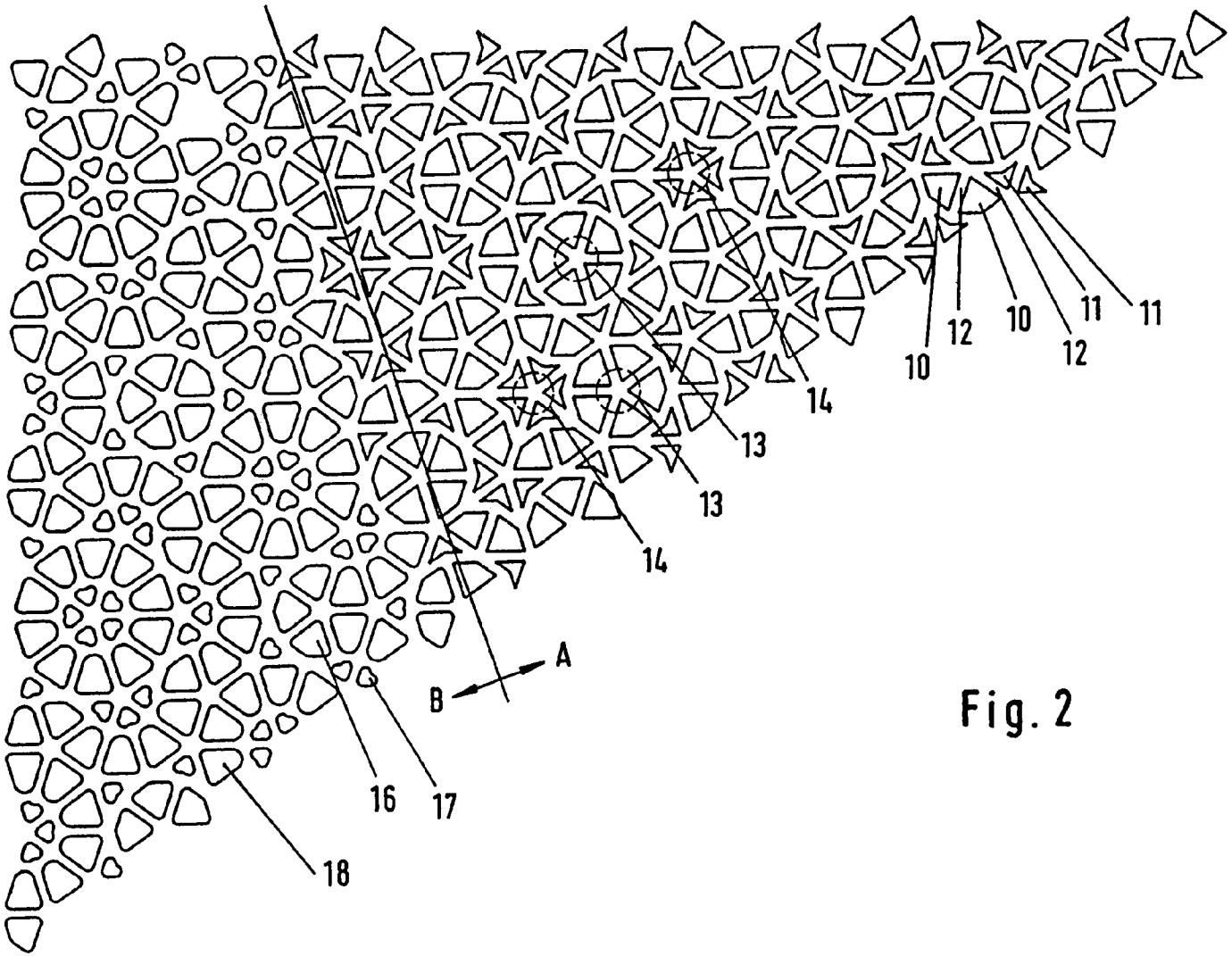
FIG. 2 shows a section from a Penrose parquet.

Referring to FIG. 2, the perforate region of shaving foil 2 is patterned with a Penrose parquet. It is a special characteristic of Penrose parquets that every pattern therein keeps on recurring, but not regularly. Penrose patterns are therefore a special class of non-periodic parquets, which are also referred to as quasi-periodic because each sub-pattern of the parquetry reoccurs an infinite number of times but not at regular intervals. Penrose parquets are composed of surface section elements with which a periodic parquet is not possible. In particular, Penrose parquets display a so-called five-fold symmetry, cover areas of any size completely and without overlap, and are comprised of at least two different types of surface section elements.

Penrose patterns can only be assembled in accordance with one special laying plan and are therefore clearly different from unordered or chaotic patterns. With Penrose patterns it is possible to achieve significantly greater ratios of aperture area to bar area than with chaotic patterns, which is particularly important for a shaving foil's degree of efficiency.

Bars surrounding the apertures in the shaving foil 2 display a strikingly large number of different alignments on the foil surface. This large number (e.g., at least 5) of different bar alignments not only has a positive impact on the shaving characteristics (e.g., thoroughness) but also enables a very good (e.g., uniform) attachment of the shaving foil over the associated undercutter, in spite of differing aperture sizes. This applies in particular when the shaving foil has to be arched when it is attached. In prior art foils that have differing aperture size and a regular, periodic pattern, problems with the uniformity of attachment occur when mounting shaving foils on the frame because the mounting of these prior art foils easily results in local distortions that adversely affect intimate contact of the shaving foil with the associated undercutter.

The size of the previously mentioned bars of shaving foil 2 naturally affect the aperture/bar ratio and hence for the effectiveness of the shaving system. A large aperture/bar ratio is thus desirable for shaving foils with a high degree of efficiency. The bar widths should therefore be kept as small as possible, i.e., as small as necessary for production reasons and/or for strength requirements. As a result, the individual bars within a perforate region should be made with the same width. By constructing the perforate region in accordance with the Penrose parquet it is possible to obtain improved aperture/bar ratios with the same bar width than would be possible with chaotically arranged apertures in a perforate region.

The existence of variously sized penetration apertures in the foil 2 allows, for example, the shaving of longer hairs in a first shaving motion in which the hairs can easily enter into large cross-sectional apertures to be cut there. With a subsequent shaving motion it is then possible for pre-shortened hairs or shorter hairs that thread into apertures of bigger cross section, but are not cut there, to be shaved by means of the apertures of smaller cross section.

FIG. 2 shows a perforate region that is constructed in accordance with a Penrose parquet. Section A on the right of the drawing shows a perforate region formed by parqueting using two different aperture elements in accordance with Penrose. Section A contains kite-shaped apertures 10 and arrow-shaped apertures 11. The kite-shaped apertures 10 have a larger surface area than the arrow-shaped apertures 11. Between the apertures 10, 11 are bars 12 of constant width. The acute angle of the kite-shaped aperture 10 as well as of the arrow-shaped aperture 11 equals 72°. When looking at this perforate region it becomes clear that individual local patterns occur again and again but not at regular intervals. Examples of these local patterns are, for instance, the decagon-shaped aperture group 13 or the pentagon-shaped aperture group 14, in which the kite-shaped aperture elements 10 and the arrow-shaped aperture elements 11 always point with their acute angles to a common center.

The apertures in section B of FIG. 2 differs from the apertures in section A firstly in that the corners of the individual apertures are rounded. The second difference between section A and section B is that the perforate region in section B includes three different types of apertures, whereas section A includes only two different types. In section B, the aperture elements 16 and 17 correspond respectively to the kite-shaped apertures 10 and the arrow-shaped apertures 11 from section A. However, all of the corners of the aperture elements 16 and 17 are rounded, whereas aperture elements 10 and 11 are angular. A third aperture element 18 in section B has a triangular opening with an acute angle of 36° and equally rounded corners. As in section A, the widths of the bars of foil material existing between the individual apertures are constant in section B.

Figure 3:
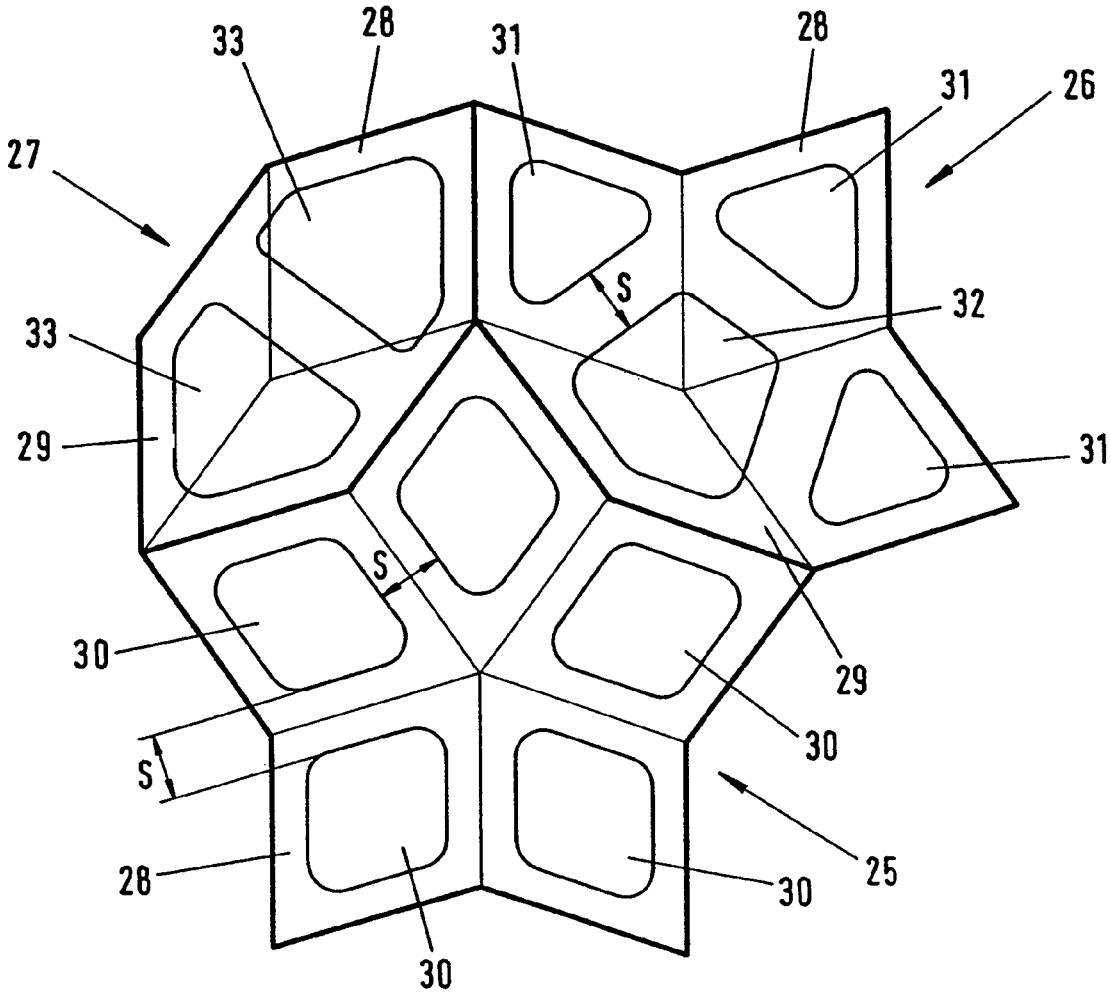
FIG. 3 shows three different surface section groups.

FIG. 3 shows three surface section groups 25, 26 and 27 whose surfaces are each composed of individual surface section elements 28, 29. The two surface section elements 28, 29 are rhombuses, each of equal edge length, with the acute angle of the surface section element 28 equaling 72° while the surface section element 29 has an acute angle of 36°.

The first star-shaped surface section group 25 is composed of five surface section elements 28 having acute corners that converge in a common point in the center of the first surface section group 25. The leaf-shaped second surface section group 26 is comprised of three surface section elements 28 and one surface section element 29. Similar to the first surface section group 25, tips of three surface section elements 28 converge at common point. On that same point also lies the corner of the obtuse angle of the surface section element 29.

The hexagonal third surface section group 27 is comprised of one surface section element 28 and two surface section elements 29. In this arrangement, the two acute angles of the surface section elements 29 lie on a common point while the acute angle of the surface section element 28 lies on a common point with two obtuse angles of the surface section elements 29.

Again, Penrose parqueting is possible using the described three surface section groups 25, 26 and 27. To form a perforate region having a Penrose parquet for a shaving foil, the individual surface section groups are equipped with penetration apertures.

Each of the surface section elements 28 of the star-shaped first surface section group 25 possesses a penetration aperture 30, which is of a rhombus-shaped configuration like the surface section element itself. However, the corners of the penetration aperture 30 are rounded. The sides of the surface section elements 28 and the sides of the penetration apertures 30 extend parallel with each other. The area of the penetration aperture 30 equals approximately 50% of the area of the surface section element 28.

The leaf-shaped second surface section group 26 is equipped with a total of four apertures. Three triangular penetration apertures 31 are provided in the outwardly facing zones of the surface section elements 28, with the corners of these triangular penetration apertures 31 being equally rounded. The aperture area of the penetration apertures 31 is somewhat greater than half the area of the penetration apertures 30. In the region of the common point of the acute angles of the surface section elements 28 and the obtuse angle of the surface section element 29 of the second surface section group 26, a provision is made for a further, pentagonal penetration aperture 32. The pentagonal penetration aperture 32 also has its corners rounded.

Provided in the hexagonal third surface section group 27 are two hood-shaped penetration apertures 33, whose tips have an angle of 72° and whose base edges extend parallel with each other so that a bar remains between the two penetration apertures 33. The corners of the penetration aperture 33 are likewise rounded.

Rounding the corners of the penetration apertures 30 to 33 ensures that no hair to be shaved is able to get caught in one of the corners, in particular the corners with an angle smaller than 90°. The radii of the rounded corners are therefore greater than half a hair diameter. The edges of the respective penetration apertures 30 to 33 are arranged such that they always extend parallel with the edges of neighboring penetration apertures. The distance between the edges of two neighboring penetration apertures and their mutual alignment is selected such that the remaining material forms bars of constant width S.

Figure 4:
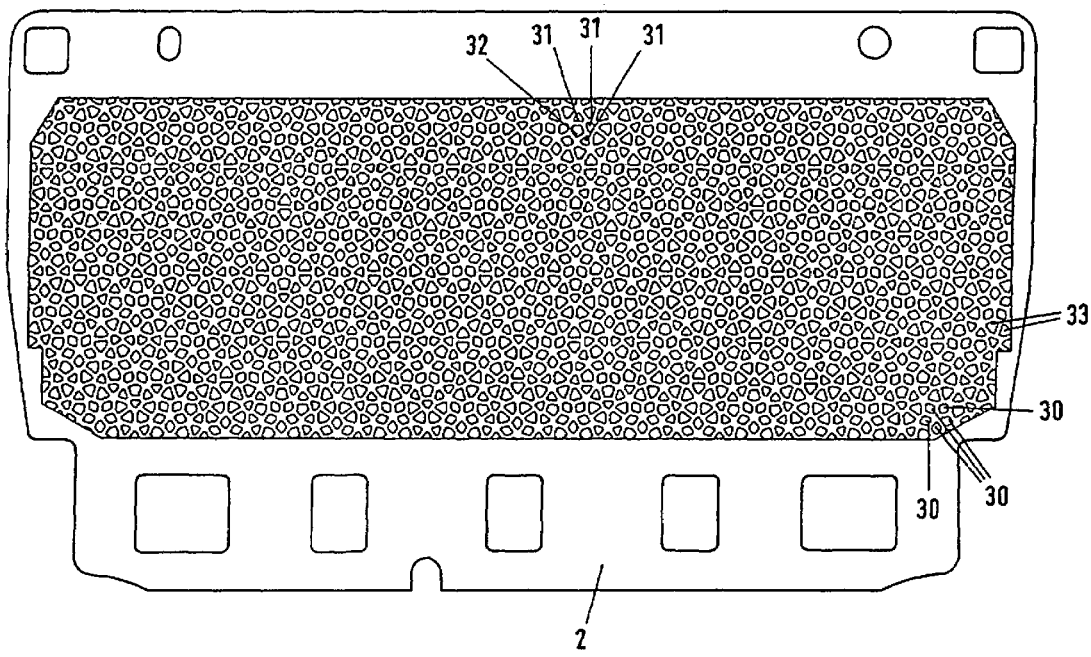
FIG. 4 shows a shaving foil whose perforate region is formed by parqueting using the surface section groups of FIG. 3.

FIG. 4 is a view of a shaving foil having a perforate region provided with penetration apertures 30 to 33 as contained in the surface section groups 25 to 27 of FIG. 3. This illustration shows a complete Penrose parquet with apertures of various size and shape. FIG. 4 also shows that the bars formed a large number of different alignments between the penetration apertures. Furthermore, when looking at the aperture pattern it becomes clear that local patterns reoccur often but irregularly. This property also contributes to lending such a pattern an interesting optical appearance. In the case of shaving foils made of a shiny foil material this optical irregularity results in a particular shine due to the variously oriented reflection of light rays.

In the shaving foil shown in FIG. 4, further cutouts for attaching the shaving foil 2 to the exchangeable frame 1 are provided outside the perforate region with the penetration apertures 30 to 33 required for shaving.

All publications, applications, and patents referred to in this application are herein incorporated by reference to the same extent as if each individual publication or patent was specifically and individually indicated to be incorporated by reference in their entirety.

A number of embodiments of the invention have been described. Nevertheless, it will be understood that various modifications may be made without departing from the spirit and scope of the invention.

What is claimed is:

1. A shaving foil for a shaving system of a shaving apparatus with at least one shaving foil and a cooperating undercutter adapted to be driven relative to each other, said shaving foil comprising at least one perforate region including a plurality of hair-receiving apertures arranged according to a quasi-periodic pattern executed according to a Penrose parquet.

2. The shaving foil of claim 1, wherein the perforate region is formed by complete parqueting using at least two different surface section elements, said surface section elements being equipped with at least one aperture.

3. The shaving foil of claim 2, wherein said surface section elements are shaped as rhombuses.

4. The shaving foil of claim 3, wherein the acute angle of the rhombuses equals 36 degrees.

5. The shaving foil of claim 3, wherein the acute angle of the rhombuses equals 72 degrees.

6. The shaving foil of claim 2, wherein the surface section elements are of equal edge length.

7. The shaving foil of claim 1, wherein the perforate region is formed by complete parqueting using at least two different surface section groups, each being equipped with at least one aperture, said surface section groups being each comprised of at least two surface section elements.

8. The shaving foil of claim 7, wherein said surface section elements are shaped as rhombuses.

9. The shaving foil of claim 8, wherein the acute angle of the rhombuses equals 36 degrees.

10. The shaving foil of claim 8, wherein the acute angle of the rhombuses equals 72 degrees.

11. The shaving foil of claim 7, wherein the surface section elements are of equal edge length.

12. The shaving foil of claim 1, wherein the apertures have different geometries.

13. A shaving foil for a shaving system, the shaving foil comprising at least one perforate region including a plurality of hair receiving apertures and arranged according to a quasi-periodic pattern arranged to have at least five-fold symmetry.

14. The shaving foil of claim 13, wherein the shaving foil is arranged to have five-fold symmetry.

15. The shaving foil of claim 13, wherein the perforate region of the shaving foil is formed by complete parqueting using at least two different surface section elements, said surface section elements being equipped with at least one aperture.

16. The shaving foil of claim 15, wherein said surface section elements are shaped as rhombuses.

17. The shaving foil of claim 15, wherein the surface section elements are of equal edge length.

18. The shaving foil of claim 13, wherein the perforate region of the shaving foil is formed by complete parqueting using at least two different surface section groups, each being equipped with at least one aperture, said surface section groups being each comprised of at least two surface section elements.

19. The shaving foil of claim 18, wherein said surface section elements are shaped as rhombuses.

20. The shaving foil of claim 18, wherein the surface section elements are of equal edge length.

21. The shaving foil of claim 13, wherein the apertures have different geometries.

22. A shaving apparatus comprising:

a shaver head including an undercutter;

a frame attached to the shaver head; and at least one shaving foil carried by the frame, wherein the shaving foil comprises at least one perforate region including a plurality of hair-receiving apertures and arranged according to quasi-periodic pattern executed according to a Penrose parquet.

23. The shaving apparatus of claim 22, wherein the perforate region of the shaving foil is formed by complete parqueting using at least two different surface section elements, said surface section elements being equipped with at least one aperture.

24. The shaving apparatus of claim 23, wherein said surface section elements are shaped as rhombuses.

25. The shaving apparatus of claim 23, wherein the surface section elements are of equal edge length.

26. The shaving apparatus of claim 22, wherein the perforate region of the shaving foil is formed by complete parqueting using at least two different surface section groups, each being equipped with at least one aperture, said surface section groups being each comprised of at least two surface section elements.

27. The shaving apparatus of claim 26, wherein said surface section elements are shaped as rhombuses.

28. The shaving apparatus of claim 26, wherein the surface section elements are of equal edge length.

29. The shaving apparatus of claim 22, wherein the apertures have different geometries.

30. The shaving apparatus of claim 22, wherein the frame carries two shaving foils.

31. The shaving apparatus of claim 22, wherein the undercutter is driven in oscillatory manner.

32. The shaving apparatus of claim 22, wherein the undercutter is driven in rotary manner.

33. The shaving apparatus of claim 22, wherein the undercutter is driven in the sense of a linear motion.

34. A method of shaving hair, comprising:

applying the shaving apparatus of claim 22 to skin including hair; and activating the undercutter.

* * * * *